United States Patent [19]

Choate et al.

[11] Patent Number: 4,689,910

[45] Date of Patent: Sep. 1, 1987

[54] FRONT SIGHT FOR PROJECTILE LAUNCHERS

[75] Inventors: Paul V. Choate, Milton; Robert W. Woodburn, Middleboro, both of Mass.

[73] Assignee: N I Industries, Los Angeles, Calif.

[21] Appl. No.: 836,746

[22] Filed: Mar. 6, 1986

[51] Int. Cl.[4] ..... F41G 1/02

[52] U.S. Cl. ..... 42/100; 33/255

[58] Field of Search ..... 33/233, 235, 252, 254, 33/255, 259, 260; 42/100

[56] References Cited

U.S. PATENT DOCUMENTS

| | | | |
|---|---|---|---|
| 835,112 | 11/1906 | Pender et al. | 33/254 |
| 3,279,072 | 10/1966 | Choate et al. | 33/233 |
| 4,531,445 | 7/1985 | Nee | 89/1.813 |
| 4,607,445 | 8/1986 | Choate | 42/100 |

*Primary Examiner*—Stephen C. Bentley

[57] ABSTRACT

Launchers of the type that are extensible when readied for use contain projectiles the efficiency of the propellants of which varies directly with their temperature. Prior to the extension of such launchers, they are water resistant and their interiors are thermally insulated and when extended, the rear and front sights become erected. The front sight, prior to launcher extension includes a sight housing in support of a sighting member having a central sighting post. One end of the sight housing is pivotally connected to the interior of the launcher housing and is under the influence of an erecting spring. The sight housing has a slideway extending to an opening through its free end and intersecting a lengthwise chamber in the sight housing. The slideway accommodates the sighting member and laterally of the chamber, the sighting member and the sight housing are interconnected in a manner enabling the sighting member to move lengthwise of the sight housing to a predetermined extent while preventing its lateral movement. A thermally responsive element within the chamber has one end connected to the sight housing below the chamber and its other end connected to the sighting member within the chamber so that when the launcher is readied for use, the front sight compensates for the existing efficiency of the propellant.

6 Claims, 10 Drawing Figures

FRONT SIGHT FOR PROJECTILE LAUNCHERS

BACKGROUND OF THE INVENTION

With weapons using a propellant that is substantially insensitive to temperature fluctuations, sighting systems need only to be adjustable to maintain the point of aim at varying distances from the target.

Propellants such as certain propellants used in the projectiles of extensible launchers present an additional problem in that they are sensitive to temperature changes with their efficiency decreasing as the temperature falls below a predetermined normal and increasing as the temperature rises above that level. The launchers, until extended, are water resistant and insulate the propellant against responding, but slowly, to temperatures to which the launchers are exposed.

Reference is made to the U.S. Pat. No. 3,279,072, to Choate et al, in which the problem of propellant efficiency in relation to temperature changes was solved by providing a rear sight which would respond to temperature changes with its thermally responsive element thermally insulated within the sight so as to reflect the temperature of the propellant thus automatically to maintain the proper point of aim.

The use of such sights required that adjustments for distance be made by means of a front sight. The resulting sighting system has proved to effectively eliminate problems in the changes in propellant efficiency due to changes in its temperature. A disadvantage is that, conventionally, compensation for distance is by means of a vertically adjustable rear "peep" sight. In addition, a sight in accordance with the patent necessarily had both the apertured sighting member and the thermally responsive member fully enclosed with the aperture moving vertically between front and rear windows and, as a consequence, such sights are relatively expensive.

Front sights in accordance with the copending application of Paul V. Choate, Ser. No. 617,377, now U.S. Pat. No. 4,607,445 meet the requirement of ensuring compensation for the efficiency of the projectile fuel as affected by the temperature thereof but impose a limitation on their use due to the fact that their height, when erected is such that corresponding changes in the rear sight are required and the resulting line of sight is objectionably high for most purposes.

THE PRESENT INVENTION

The general objective of the present invention is to provide a front sight for use with launchers where the efficiency of the propellant for the projectile is temperature responsive, which will automatically and accurately compensate for losses or gains in propellant efficiency, and which will enable low sighting line requirements to be met.

In accordance with the invention, this objective is attained with a front sight having a housing which, like the front sights of the U.S. Pat. No. 3,122,059 to Choate et al, and U.S. Pat. No. 4,531,445 of Michael A. Nee, is pivotally mounted within the muzzle end of a housing sealed to a section of an extensible launcher to be erected by a spring when a port in that housing is opened which it is as an incident of launcher extension. The front sight is substantially as effectively insulated while within the housing of the launcher until thus erected as is the projectile.

The sight consists of a sighting member having a central sighting post and a housing having one end connected to the interior of a launcher in a location in which it is erected through a launcher port when opened, in practice when the launcher is extended for use.

The sight housing has a slideway opening through its free end and closed adjacent its connected end and is shaped and dimensioned to receive and confine the sighting member with the sighting post exposed. The sight housing also has a central chamber, a substantial portion of which is intersected by the slideway and laterally of it, the sighting member is connected to the sight housing in a manner permiting the sighting member to be slid relative to the sight housing between a predetermined advanced or elevated position and a predetermined retracted or lowered position without any lateral movements that could affect accuracy. The chamber receives a thermally responsive element one end of which is connected to the sight housing below the chamber and the other end of which is connected to the sighting member short of the upper end of the chamber. The thermally responsive element is selected to ensure the wanted elevation of the sighting member as the temperature to which it is subjected rises above a predetermined value and to lower the sighting member as the temperature falls below that value.

While the sliding confinement of the sighting member prevents forward or rearward movements thereof, a particular objective of the invention is to hold the sighting member against any discernable lateral movements, an objective attained by employing slidable connections between the sighting member and the sight housing laterally of the chamber, preferably at both sides thereof, of substantial length with their upper ends close to the upper end of the sighting member.

Yet another objective of the invention is to provide a front sight construction in which the sight housing consists of forward and rearward sections between which the sighting member is confined and to which the sighting member is slidably connected, at least in part by connections interconnecting the sight housing sections.

For this purpose, the sections have flat surfaced lower portions which in the assembled sight are in mutual contact and flat surfaced upper portions spaced apart to establish the slideway for the sighting member. Each section has a central cavity extending lengthwise thereof and forming part of the chamber. In practice, one of the sections is formed with forwardly extending, flat surfaced recessed shoulders in order to establish the slideway when the sight is assembled.

The interconnection of the sections is effected by means of posts or pins adjacent their side edges at their lower ends and also through the slideway adjacent the upper end thereof. Third posts or pins are within the slideway, each in lengthwise alignment with the appropriate one of the upper posts but spaced therefrom. The sighting member has parallel slots of greater length than the distance between the posts in the slideway and shaped and dimensioned to receive said posts thus to establish slidable connections between the sighting member and the sight housing.

In practice as is preferred, the posts are formed integrally with the section having the recessed shoulder and those adjacent the ends thereof pass through appropriately located holes in the other section with their exposed ends sealed thereto. The uppermost posts in the slideway are formed with bosses which are shaped and dimensioned to fit the slots of the sighting member and to serve as spacers against which the other housing section seats. The other slideway posts are preferably dimensioned as to present their upper ends in the plane of the lower portion of the recessed section thus also to function as spacers rather than to employ them to interconnect the sections.

BRIEF DESCRIPTION OF THE DRAWINGS

The accompanying drawings illustrate a preferred embodiment of the invention of which

THE PREFERRED EMBODIMENT OF THE INVENTION

As previously stated, the preferred embodiment of the front sight is shown as incorporated in a projectile launcher which is in accordance with U.S. Pat. No. 4,531,445, granted July 30, 1985, to Michael A. Nee.

The launcher is generally indicated at 10 and while a full description thereof is not necessary for a general appreciation of front sights in accordance with the invention, certain of the front sight features are more readily appreciated when considered with certain features and the general functioning of the launcher 10 thus making a general description thereof desirable.

Figure 1:
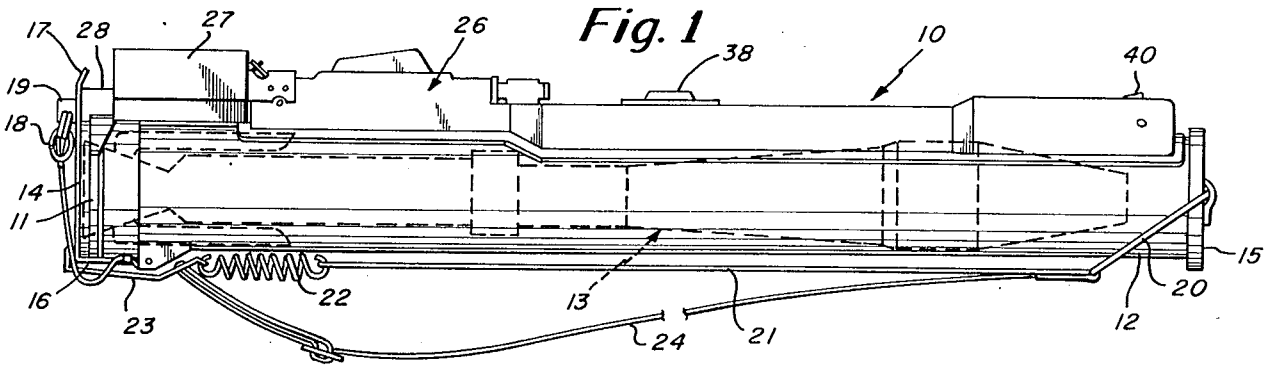
FIG. 1 is a side view of an extensible projectile launcher in its shortened inoperative state equipped with a front sight in accordance with the present invention.
Figures 3, 4, 5, 6:
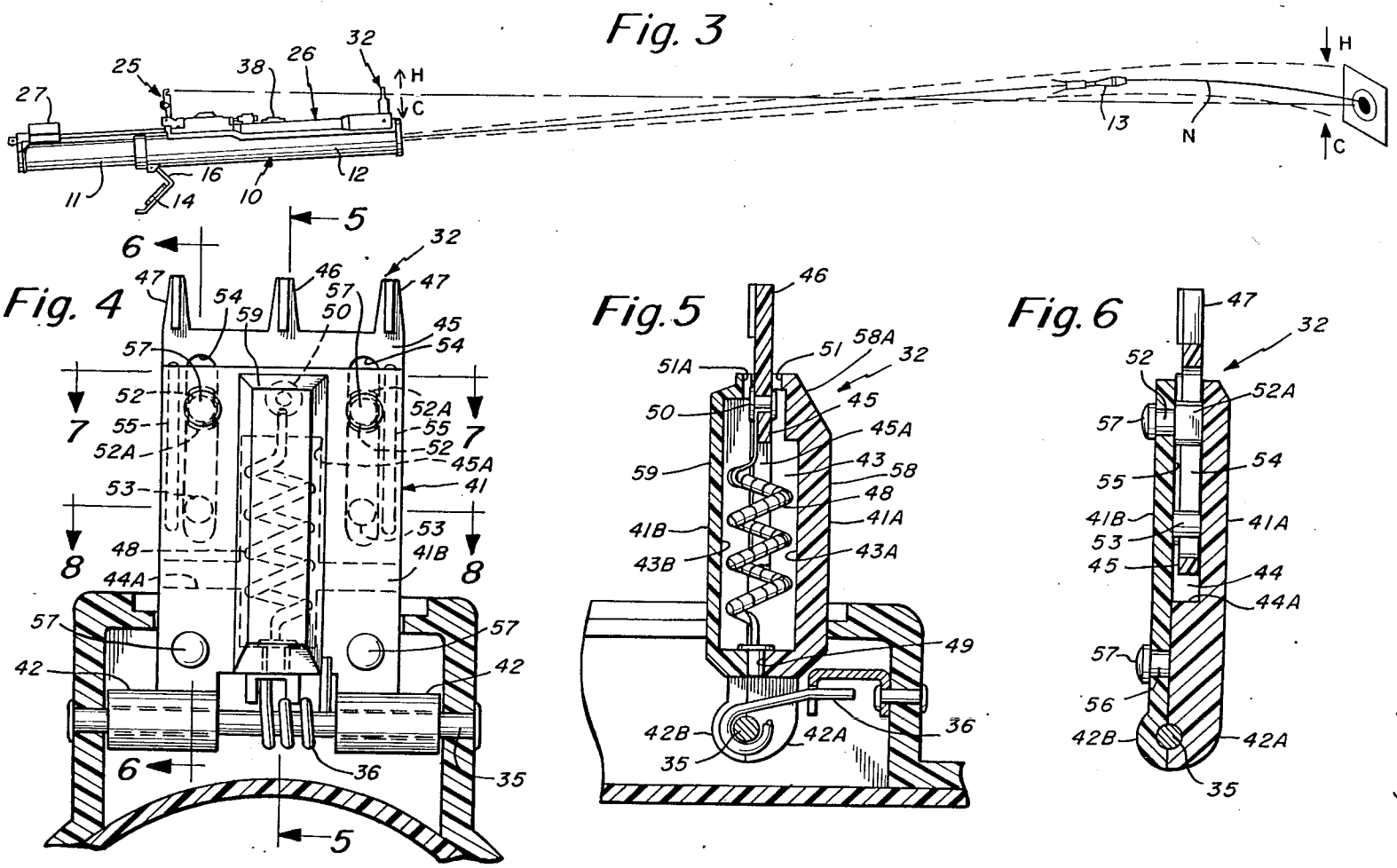
FIG. 3 is a view with the launcher in its extended state illustrating the functions of the front sight.
FIG. 4 is a section, on a substantial increase in scale taken approximately along the indicated line 4—4 of FIG. 2.
FIG. 5 is a section taken along the indicated line 5—5 of FIG. 4.
FIG. 6 is a section taken along the indicated line 6—6 of FIG. 4.

The launcher 10 has a first or breech section 11 which is telescopingly fitted within a second or muzzle section 12 thus to enable the launcher to be extended from its shortened, inoperative state illustrated by FIG. 1, in which it may be carried conveniently, into its extended state in which the contained projectile 13 is ready to be launched, see FIG. 3.

The breech end of the section 11 and the muzzle of the section 12 are closed by end caps 14 and 15, respectively, which together with seals and certain other later referred to features serve to render the launcher 10 water tight in its shortened state.

The rear cap 14 has, see FIG. 1, an arm 16 extending at right angles from its lower margin and pivotally connected to the section 11 close to the rear end thereof, the rear cap 14 also has a diametrically disposed tab 17 fitting over and locked by a removable pin 18 to a rearwardly disposed lug 19 with which the launcher section 11 is provided. The front cap 15 has a yoke 20 connected to a strap 21 having a resilient section 22 which includes a hook 23 caught on the edge of the end cap 14 and overlying the arm 16. A carrying strap 24 is attached to the yoke 20 and to the shank of the hook 23.

With the removal of the pin 18, the rear cap 14 is swung open by means of its tab, the hook 23 becomes disengaged therefrom and it, the straps and the front cap 15 fall free. The launcher can then be extended. For more complete details of the above feature, reference is made to U.S. Pat. No. 3,122,059 to Choate et al.

The rear sight, generally indicated at 25 and forming no part of the present invention but shown as illustrative of a so called "peep" sight, proving for range adjustments, is pivotally connected to the rear end of a housing 26 which is sealed to and extending substantially the full length of the launcher section 12. In the shortened state of the launcher, the rear sight 25 is slidably confined in a chamber 27 mounted on a housing 28 containing the firing pin 29 and the firing spring 30 and fixed on the breech end of the launcher section 11. The rear sight 25 is held by the chamber 27 from being erected by the spring 31 until the launcher has been so extended that the rear sight is pulled free of the chamber 27. The firing mechanism is not otherwise shown or described as forming no part of the present invention.

In the shortened state of the launcher 10, the firing spring 30 is untensioned and the front sight, generally indicated at 32, is below an oblong port 33 in the front end of the housing 26 which is closed by an underlying plate 34. The front sight 32 is connected by a pivot 35 to the sidewalls of the housing 26 and is erected and seated against the front edge of the port 33 by a spring 36 when the plate 34 is positioned rearwardly of the port 33 as it is when the launcher is extended for use.

A channel 37 is anchored to the housing 28 and extends lengthwise through the housing 26 and is slidably supported by the launcher section 12. The housing 26 has a boot covered port 38 rearwardly of the port 33. The plate 34 is connected to the forward end of the channel 37 as at 39.

During extension of the launcher, the plate 34 is moved rearwardly relative to the launcher section 12 and the front sight 32 becomes erected through the now open port 33 by means of the spring 36. When the launcher is fully extended, a latch 40 on the plate 34 is caught in the port 38 to detachably secure the launcher in its extended state.

Figure 2:
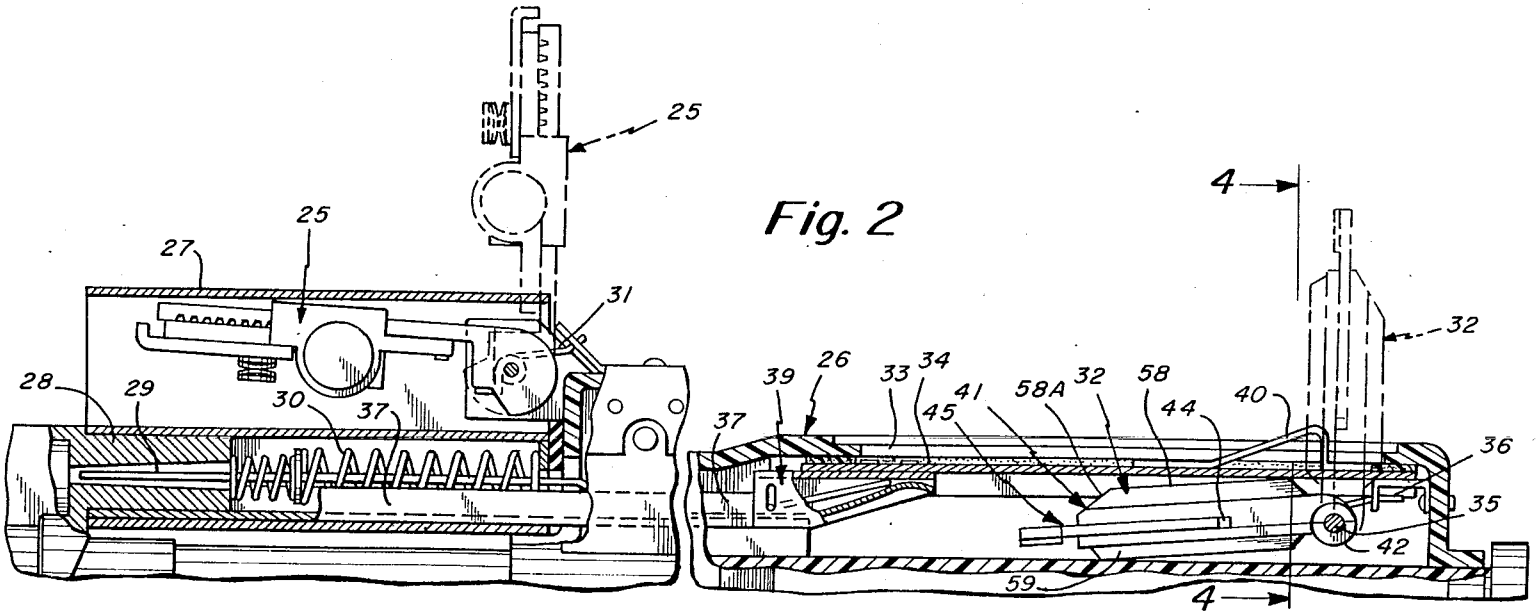
FIG. 2 is a fragmentary and foreshortened view showing in solid lines the front and rear sights when the launcher is in its shortened state and in broken lines the sights when erected.
Figure 7:
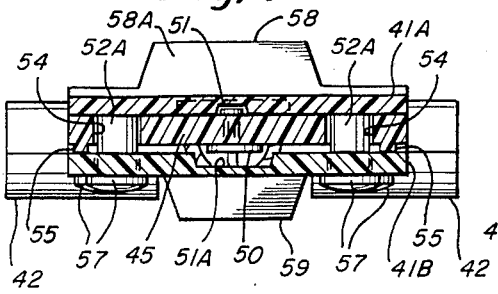
FIG. 7 is a section taken along the indicated line 7—7 of FIG. 4.
Figure 8:
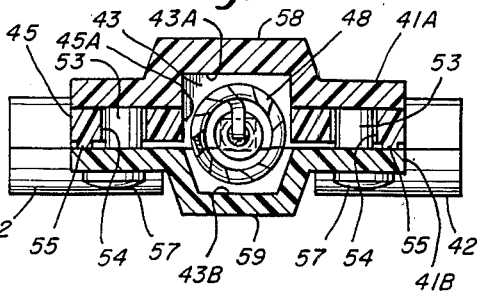
FIG. 8 is a section taken approximately along the indicated line 8—8 of FIG. 4.
Figure 9:
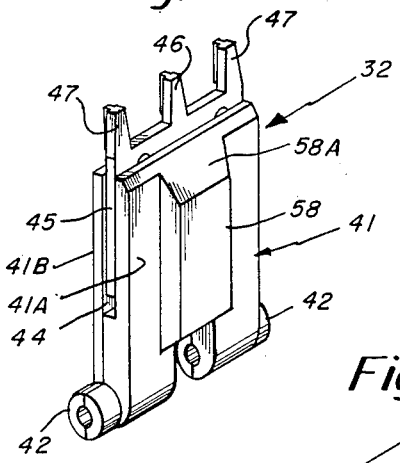
FIG. 9 is a perspective view of the front sight as seen from its front side, i.e., the side disposed toward the muzzle of the launcher.
Figure 10:
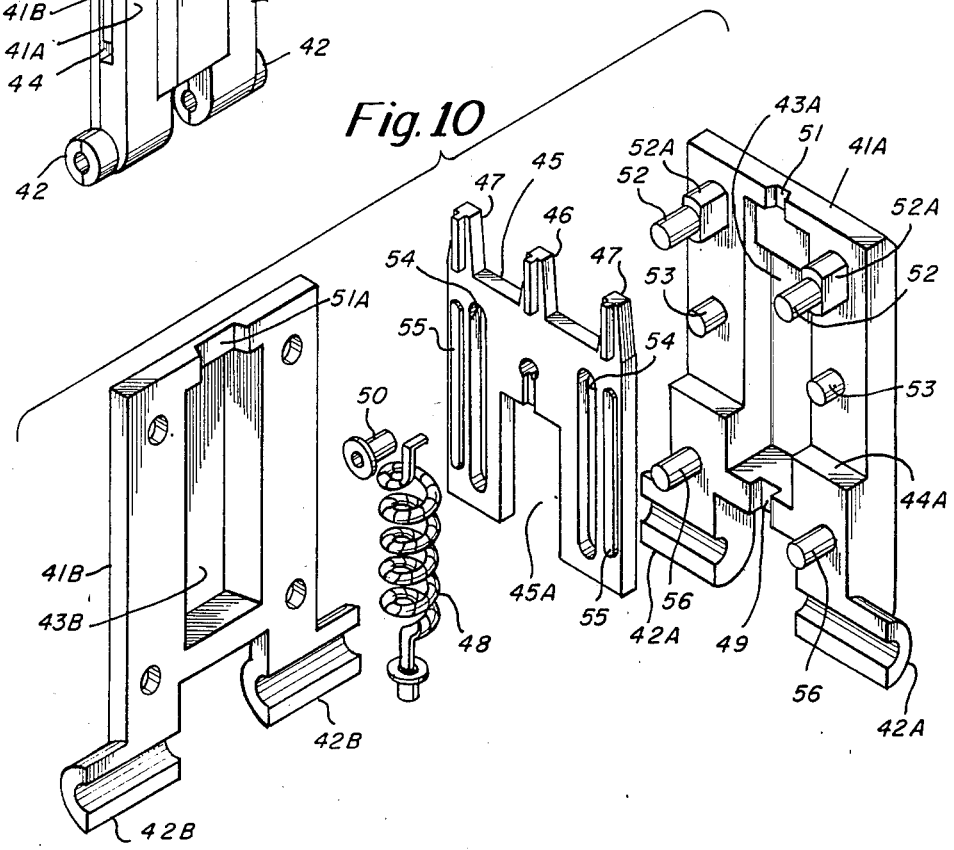
FIG. 10 is an exploded view of the sight.

The front sight 32, see FIGS. 2, 4, and 7, has a housing, generally indicated at 41, provided at one end, hereinafter referred to as the connected or lower end, with laterally spaced ears 42 which receives the pivot 35 by which the housing 41 is connected to the launcher housing 26 and which also supports the sight erecting spring 36. The housing 41 has a central chamber, generally indicated at 43 and a transverse slot opening through its free end and the sides thereof establishing a slideway, generally indicated at 44, which intersects the chamber 43 and slidably confines the sighting member 45. The sighting member has its exposed end provided with a central sighting post 46 and lead indicating posts 47, one on each side of the post 46 and equally spaced therefrom.

The housing 41 consists of sections 41A and 41B, see FIGS. 5–8 and 10. The section 41A is hereinafter called the front section as it is disposed towards the muzzle of the launcher 10 when erected and the section 41B which then faces the rear sight is accordingly called the rear section. The front section 41A has a recessed shoulder 44A extending to the free end of the housing and intersecting the major portion of the chamber 43 to establish the slideway 44. The sections 41A and 41B have cavities 43A and 43B, respectively and best seen in FIG. 10, which in the assembled sight form the chamber 43.

A thermally responsive element 48 extends lengthwise of the chamber 43 and has one end anchored as by an epoxy in a notch 49 at the lower end of the cavity 43A. The sighting member 45 has a central slot 45A opening towards the lower end of the housing and shaped and dimensioned freely to accommodate the element 48 the upper end of which is connected to the sighting member 45 above the closed end of the slot 45A as by an eyelet 50. The upper end portion of the section 41A has a notch 51 dimensioned freely to accommodate the upset end of the eyelet 50. It will be appreciated that the above construction enables the length of the chamber 43 to be such as only to accommodate the element 48 when expanded to a maximum extent and the depth of the recessed shoulder 44A is such that a slideway 44 is provided which slidably confines the sighting member 45 against any appreciable fore and aft movements.

The sighting member 45 is slidably connected to the sight housing 41 by connections on each side of the chamber 43. Each connection has first and second posts 52 and 53 extending through a slot 54 extending lengthwise of the sighting member 45 and of sufficient length relative to the post to permit the sighting member 45 to move vertically throughout its wanted range and of a width to so fit the posts as to prevent any lateral movements of the sighting member that would affect accuracy. For convenience in establishing the desired working clearance between the sight housing 41 and the sighting member 45, the sighting member is shown as having lengthwise narrow portions 55, the thickness of which is such as to ensure a minimum clearance. The posts 53 are so dimensioned that their upper ends are in the plane of the flat surfaced section 41A below the flat surfaced recessed shoulder 44A while the posts 52 have elongated bosses 52A dimensioned both to fit the slots 54 and present their upper surfaces in the above referred to plane thus ensuring that the slideway 44 will be uniform throughout its length when the sight is assembled. Except for its cavity 43B and a notch 51A which with the notch 51 ensures the free accommodation of the eyelet 50, the section 41B is flat surfaced.

The housing sections 41A and 41B are interconnected by the posts 52 and by posts 56 below the slideway 44 and it is preferred that the posts 52, 53, and 56 be integral with the section 41A. The posts 52 and 56 extend through holes in the section 41B and their exposed ends are sealed thereto as at 57.

It will be noted that each of the sections 41A and 41B has at their lower end, portions 42A and 42B, respectively, forming one-half of the ears 42. It will also be noted that the sections 41A and 41B have lengthwise bosses 58 and 59, respectively, enabling the cavities of each to be of a depth required for the cross sectional area of the chamber 43 without requiring overly thick margins. The taper 58A at the end of the boss 58 adjacent the free end of the sight housing 41 is engageable by the free end of the slide as the launcher 10 is placed in its shortened state, thus to force the front sight 32 into its inoperative position.

We claim:

1. A thermally responsive front sight for a launcher of a projectile the efficiency of the propellant of which varies with the temperature thereof, the launcher of a type having a port opening into a thermally insulated housing adjacent the muzzle and provided with a removable closure, said sight including a sighting member provided with a central sighting post, said sighting member thin and flat surfaced, a sight housing including means at one end for use in connecting said sight housing to the interior of said insulated housing below said port in a position to be erected therethrough and having a central lengthwise chamber the width of which is substantially less than the width of the sighting member, said sight housing having a transverse slideway opening through the other end thereof and intersecting a substantial portion of said chamber and shaped and dimensioned to receive and slidably confine said sighting member, said sighting member within said slideway with a central portion exposed in said chamber and with the sighting post exposed above said housing, portions of the sighting member at each side of the chamber having lengthwise parallel slots, and a thermally responsive element within said chamber with one end anchored in the bottom thereof and the other end of the element attached to said exposed central portion, said element of the type expanding lengthwise as the temperature rises and contracting as the temperature falls, and means on each side of said chamber entrant of the appropriate one of the slots of the sighting member and dimensioned to enable said sighting member to be moved vertically by said element while holding said sighting member against lateral movement.

2. The thermally responsive sight of claim 1 in which each of the connecting means consists of first and second posts carried by the sight housing and spaced along and intersecting the slideway, and each slot is receptive of the appropriate ones of said first and second posts and is of a length greater than the distance between said posts.

3. The thermally responsive sight of claim 2 in which the sight housing consists of forward and rearward portions, each section has a cavity forming a portion of the chamber, one section has a recessed shoulder extending forwardly from the lower part of the chamber along both sides thereof to the upper end of the sight housing, said housing section and said other section have flat surfaced portions in mutual contact, the recessed shoulder is flat surfaced, the portion of said other section that overlies the recessed shoulder is flat surfaced and coplanar, there are laterally spaced posts interconnecting the first named flat surfaced portions and the first; post of each pair is adjacent the open end of the slideway and interconnects the walls of the slideway.

4. The thermally responsive sight of claim 3 in which the second post of each pair has its upper end in the plane of the first named flat surfaced portions and the first posts have base portions in alignment with the appropriate sighting member slot and providing supporting surfaces in said plane.

5. The thermally responsive sight of claim 4 in which the supporting base portions establish the wanted minimum clearance between the sighting member and the walls of the slideway appropriate for the thickness of the sighting member.

6. The thermally responsive sight of claim 1 in which the slideway is open along both sides of the sight housing and the walls of the slideway are flat surfaced, the sighting member is substantially as wide as the slideway, and the connecting means spaced along the slideway on both sides of the chamber also hold the slideway walls parallel.

* * * * *